United States Patent [19]

Bessac

[11] Patent Number: 4,508,390

[45] Date of Patent: Apr. 2, 1985

[54] MACHINE FOR MAKING UNDERGROUND GALLERIES

[75] Inventor: Michel Bessac, Realmont, France

[73] Assignee: Foncages et Forages Bessac, S.A., Realmont, France

[21] Appl. No.: 500,413

[22] Filed: Jun. 1, 1983

[30] Foreign Application Priority Data

Jun. 2, 1982 [FR] France ..... 82 09835

[51] Int. Cl.[3] ..... E21D 9/08

[52] U.S. Cl. ..... 299/33; 405/143; 175/61; 403/377

[58] Field of Search ..... 299/31, 33; 405/143 X; 285/31, 303, 302; 403/377 X; 175/61 X

[56] References Cited

U.S. PATENT DOCUMENTS

| | | | |
|---|---|---|---|
| 3,556,599 | 1/1971 | Fikse | 299/33 |
| 3,919,851 | 11/1975 | Plourde | 405/143 |
| 4,027,903 | 6/1977 | Hannover | 285/156 |
| 4,203,626 | 5/1980 | Hamburger | 299/33 |
| 4,224,004 | 9/1980 | Heitkamp | 299/31 |
| 4,436,448 | 3/1984 | Magnus et al. | 405/143 |

FOREIGN PATENT DOCUMENTS

| | | | |
|---|---|---|---|
| 2307123 | 11/1976 | France | 299/33 |

*Primary Examiner*—Stephen J. Novosad
*Assistant Examiner*—Mark J. DelSignore
*Attorney, Agent, or Firm*—Harold H. Dutton, Jr.

[57] ABSTRACT

The invention concerns an improved machine for making underground galleries. This machine comprises a shield consisting of two mutually movable parts, a forward knife casing 1 supporting on its inside a digging device 3 and a rear assembly skirt 2 acting as a guide means for a thrust ring 10. The knife casing and the assembly skirt are mutually connected by a slack fastening system allowing them to pivot with respect to each other in such a manner that their longitudinal axes form an adjustable angle.

The machine of the invention applies to making underground galleries provided with coverings bracing the earth; it makes possible marked curves without the requirement of out-of-path earthworks.

12 Claims, 10 Drawing Figures

MACHINE FOR MAKING UNDERGROUND GALLERIES

The invention concerns improved machinery for digging underground galleries; its object is a machine making possible to dig an underground passageway and to gradually equip this passageway, in step with the advance of the machine, with soil-bracing cover elements such as pipe-stubs or large hoops.

BACKGROUND OF THE INVENTION

Such machinery is already known and essentially consists of a hydraulic shield and cutting equipment housed within the shield. The cutting equipment as a rule consists of a miller supported by an arm which is suspended from the high part of the shield, and this equipment makes it possible to dig and to break up the soil ahead of the shield, this soil being evacuated rearward by a conveyor means; the hydraulic shield includes a thrust ring which is linked to a hydraulic thrust system and in this manner the shield can be moved forward after the suitable front work on the soil has been done; to achieve this progressive advance, the thrust ring rests on the pipes or hoops already in place behind the machine and the hydraulic thrust system linked at its other end to the shield exerts an advancing force on this shield.

Such machines have long been well known to the experts but incur several drawbacks which hitherto have defied remedy.

In the first place, it is quite difficult to make curves using this type of machinery, which requires earth work both extraneous and of large cross-section and hence much personnel; futhermore, the curves that are made evince very large radii (the radii of curvature generally are hundred-fold or more the drift diameter). Also, in some loose terrains, it is sometimes impossible to achieve curves using the known machinery and the experts must resort to wholly manually performed earthworks. Moreover, even when operating in a straight line, these machines are ill suited to dig in loose terrains because these tend to "pack" the miller means and to draw very high power.

It is the object of the present invention to remedy the drawbacks in the above known machines by providing an improved machine designed to operate on the same general principle as the known ones.

One essential object in particular of the invention is to make possible much shaper curves without thereby having to perform earthwork outside the proper contours; especially the object of the invention is to make curves of which the radii can be easily adjusted down to a minimum value about 15 times the diameter of the work.

Another object of the invention is to provide a machine suitable to operate in any terrain and in particular in a loose one, both in straight lines and in curves.

Thus one object of the invention is to provide in this manner a universal machine which without difficulties can dig galleries in terrains with strata of different kinds.

DESCRIPTION OF THE INVENTION

To that end the machine of the invention is of the kind including on one hand a hydraulic shield provided with a thrust ring and a hydraulic thrust system, and on the other hand with a digging device located within the shield; in accordance with the present invention, said machine is characterized in that the shield comprises two mutually movable parts:

a forward part, called the knife casing, which internally supports the digging device, and a rearward part, called the assembly skirt, which acts as a guide means for the thrust ring, where said knife casing and said assembly skirt are interconnected by a slack fastening means designed to tie them together on one hand in the longitudinal direction and on the other hand rotationally about their longitudinal axis while nevertheless allowing a low-amplitude pivoting motion of one with respect to the other about an axis which is orthogonal to their longitudinal axis, whereby they can be mutually oriented in such an angular geometry that their longitudinal axes form an adjustable angle $\alpha$.

As used herein the expressions "foreward" and "rearward" refer to the advance of the machine; furthermore the terms "horizontal" and "vertical"—which are used below—assume that the machine is in its operational position, the longitudinal axes of the knife casing and of the assembly skirt being horizontal.

In a preferred embodiment, the slack fastening between the knife casing and the assembly skirt is designed to allow said casing and said skirt to pivot relative to each other in adjustable manner up to a value of 4°.

The aforementioned slack fastening in particular may include a plurality of coupling lugs and traction studs distributed around the shield, the former fixed to the front of the assembly skirt and the latter to the rear of the knife casing, each traction stud entering an aperture of the coupling lug with a clearance designed to permit the above-cited relative pivoting motion between said knife casing and said assembly skirt.

Furthermore in another feature of the invention, the knife-casing includes an external centering sleeve fixed to the rearwards part and wherein nests an internal centering sleeve which is fixed to the forward part of the assembly skirt, these sleeves being so dimensioned that they are kept apart by a functional play chosen to allow the above-cited mutual pivoting motion between the knife casing and the assembly skirt.

Advantageously the hydraulic thrust system for the shield consists of several hydraulic jacks with independent controls and distributed around the shield, each jack being linked at the fore to an annular support solidly joined to the knife casing and at the rear to the thrust ring sliding in the assembly skirt.

In this manner the machine of the invention allows orienting the forward part of the shield (knife casing) supporting the digging device in a chosen direction so as to subtend an angle which varies with respect to the rearward part (assembly skirt) that makes possible to emplace the covering elements. The knife casing is aimed by independently controlling the thrust jacks during the advance procedure of the shield. The jacks toward the outside of the curve to be made are lengthened more than those on the inside, the elongation ratios defining the aiming angle $\alpha$. The digging device therefore can operate in an angular direction offset from the previous direction while nevertheless permitting on one hand to operate conventionally at right angle to the contour of the knife casing and on the other hand to conventionally emplace covering elements in the assembly skirt.

Experimentation has shown that subtending an angle of 4° between the cutting heel and the assembly skirt makes possible curve radii as low as 15-fold the shield diameter.

Furthermore, in the light of other features of the improved machine of the invention, the digging device includes:

a fixed frame connected to the inside of the knife casing and providing an essentially vertical platform about the axis of said casing, a bearing ring supported on said platform so that its axis coincides substantially with the axis of the knife casing, a revolving frame supported on the above-cited bearing ring so it can pivot by 360° , essentially about the knife-casing axis, drive means to set the revolving frame into rotation, a digging jib hinging on the revolving frame and provided at its end with an operational tool, and a hyraulic jack to actuate said jib, linked to said jib and to the revolving frame in such a manner that the hinge-point of the arm on the frame, the linkage-point of the jack with the frame end and the linkage-point of the jack on the jib never shall be aligned.

As will be better understood below, this arrangement makes it possible for the jib to easily sweep the cross-section of the breast (ahead of the knife casing) by the combination of 360° rotation of the revolving frame and the jib actuations with respect to said revolving frame. Furthermore the tool can be made to work in any position; under these conditions, the jib is advantageously equipped with a scoop capable of operating forward or backward, whereby both loose and hard terrains can be dug without difficulty.

Also, in another feature of the invention which facilitates the scoop penetration into the earth ahead of the knife casing, the digging jib is made telescoping and is provided with a hydraulic jack to retract or extend it.

DESCRIPTION OF THE DRAWINGS

The invention which was discussed above in its general form will be better understood by reading the description below and in light of the attached drawings showing an illustrative embodiment without thereby implying any limitation; these drawings are an integral part of the present description.

FIGS. 6, 8, 9 and 10 are schematics illustrating the operation of the machine, while

DESCRIPTION OF THE DRAWINGS

The improved machine illustratively shown in FIGS. 1, 2, 3, 4, and 5 is intended for making underground galleries of a diameter varying between 1.80 and 6 meters. Essentially this machine comprises on one hand a shield consisting of two parts, a forward knife-casing 1 and a rearward assembly skirt 2, and on the other hand a digging device 3 supported by the knife casing 1.

Figure 5:
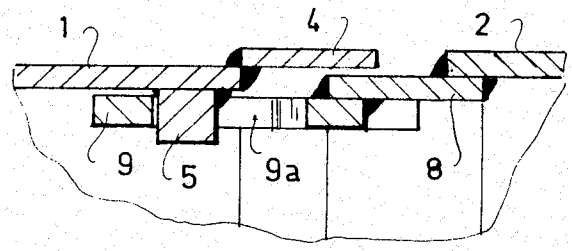

The knife-casing 1 is in the shape of a cylindrical steel pipe provided with an upper cap 1*a* at its fore part; at its rear part it is provided with an external centering sleeve 4 welded on said knife casing so that its thickness projects outside the knife casing, as shown in FIG. 5.

Furthermore several traction studs such as 5 are internally welded for instance in a total of six at the rear of the knife casing and are distributed over its periphery near its connection to the sleeve 4.

Moreover an annular support 6 is welded inside and on an intermediary section of the knife casing 1, several hydraulic jacks such as 7 (for instance six in all) being spread across the periphery of the shield and hinge on said support 6. The cylinder of each jack hinges on support 6 by a conventional yoke means.

Also, the assembly skirt 2 is in the form of a cylindrical steel pipe, with a diameter slightly exceeding that of the knife casing 1 and approximately equal to that of the external sleeve 4 welded to the rear of said knife casing.

An internal centering sleeve 8 is welded to the front of the skirt 2 and projects by its thickness within said skirt as shown in FIG. 5 The sleeve 8 nests in the sleeve 4, the two sleeves being provided with an operational play between them so as to permit a relative pivoting motion of the knife casing with respect to the assembly skirt about an arbitrary axis orthogonal to the axis of these elements. The sleeves 4 and 8 overlap over a variable longitudinal distance which is a function of the relative position between the skirt and the knife casing, and said sleeves 4 and 8 providing guidances and relative centering of these elements, thereby averting any danger of transverse offset.

Furthermore several coupling lugs such as 9, which in this example are six in number, are welded on the inside at the front of the centering sleeve 8 near the traction studs 5. Each coupling lug 9 is provided with an aperture 9*a* of which the longitudinal dimension much exceeds that of a traction stud 5 and with a transverse dimension slightly exceeding that of said stud 5. Each of the studs 5 enters an aperture 9*a* of a lug, whereby the whole of these elements constitutes a slack fastener means connecting together with a given slack the skirt 2 and the knife casing 1, on one hand in the longitudinally direction and on the other hand rotationally about their longitudinal axis, while permitting these elements to pivot, whereby their longitudinal axes form a given angle of which the maximum value may reach 4°.

Furthermore the skirt 2 guides a thrust ring 10 which is mounted in sliding manner in it. The mobile rods of the hydraulic jacks 7 are linked in conventional manner per se to this ring. These jacks are provided with a hydraulic supply system whereby they can feed and controlled individually in order to individually regulate their extension and to thusly adjust the relative angular position of the knife casing 1 to the skirt 2.

The digging device 3 supported by the knife casing 1 includes a frame 11 provided with three tripod extensions whereby the frame 11 is fixed in place inside the knife casing 1 and toward its rear. This frame forms a substantially vertical platform 11*a* around the axis of the knife casing in order to define a central cavity.

A revolving frame 12 is mounted at the front of the structure 11 on the vertical platform 11*a* by means of a known type bearing ring (symbolized by 13 in FIGS. 1 and 2); this bearing ring has a horizontal axis coinciding with that of the knife casing and can be of the crossed-roller type, its outer race being fastened to the platform 11*a* and its inside race to the frame 12. The inside race is provided with toothing 14 engaging a pinion 15 which is articulating on the platform 11*a* and rotationally driven by a hydraulic engine 16 supported on the rear of said platform 11*a*.

The revolving frame 12 therefore can be rotationally driven by 360° about a horizontal axis substantially coinciding with the axis of the knife casing 1.

Figure 1:
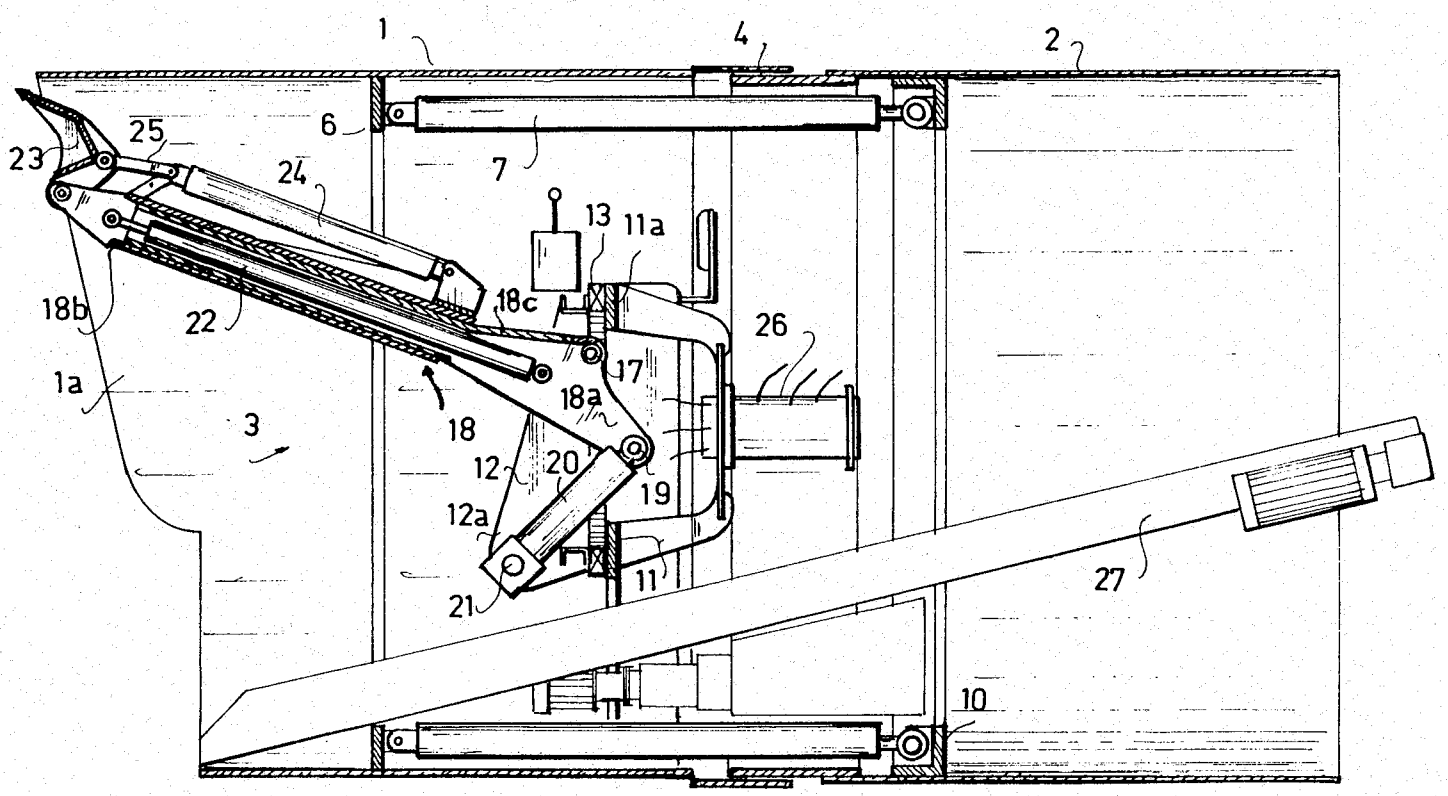
FIG. 1 is an axial section through a vertical plane AA of a machine of the invention.

A digging jib 18 hinges on that revolving frame by a shaft 17 parallel to the plane of the platform 11*a* and located near it, this hinging shaft being offset from the fictional center of the platform. Furthermore the digging jib 18 comprises a rear extension 18*a* which is housed in the cavity part of the structure 11. The mobile rod of an actuating jack 20 is linked by a shaft 19 to said extension. This jack slopes rearward as shown in FIG. 1 and its cylinder is linked to a forward extension 12*a* of the revolving frame at a coupling point 21 located opposite the jib hinging point 17 compared to the axis of the knife casing.

The jib hinging point 17 and the link points 19 and 21 of the actuating jack therefor are arranged in a triangle and the above described array of the elements makes it possible both to assure a good effectiveness of the actuating jack regardless of the position of the jib 18, and to substantially reduce the bulk at the fore of the platform so as to clear the work area and to permit sweeping all of this area with the jib (in spite of the shield being divided into two pieces), whereby the length of the knife-casing housing the digging device is substantially reduced.

Furthermore the digging jib 18 advantageously is made telescoping and comprises two legs 18*b*, 18*c* sliding within each other and a hydraulic jack 22 within said legs and linked to them in order to move the leg 18*b* with respect to the leg 18*c* whether for extension or retraction.

The leg 18 is provided at its end with a scoop 23 operated by conventional hydraulic actuating means including a hydraulic jack 24 and transmission cranks 25 to allow placing the scoop both in the forward and back positions.

The various jacks fixed to the revolving frame 12 (jacks 20, 22 and 24) are fed with pressurized oil from a conventional-type revolving hydraulic coupling 26.

The above described digging device can efficiently dig both loose terrains and harder ones; because of the sweep of the jib and the 360° rotations, the scoop can be made to operate as well moving forward or pulling back, the telescoping nature of this jib making possible a good forward penetration of the scoop.

Such a digging device is fitted to the geometry of two distinct parts of the shield and is free of the defects found in the conventional millers.

Figure 2:
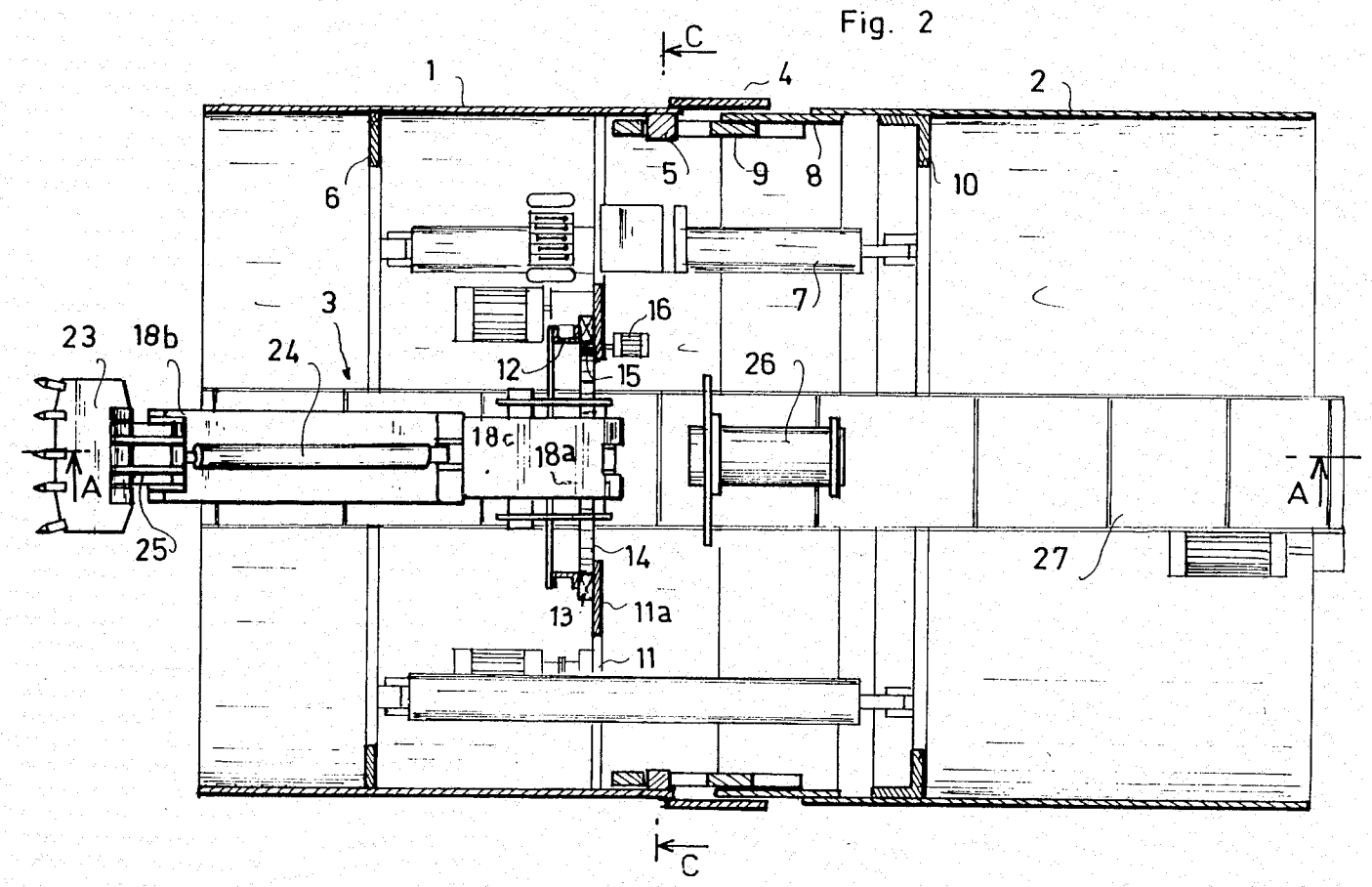
FIG. 2 is a horizontal plane BB section where the digging device is not shown in section but in top view.
Figure 4:
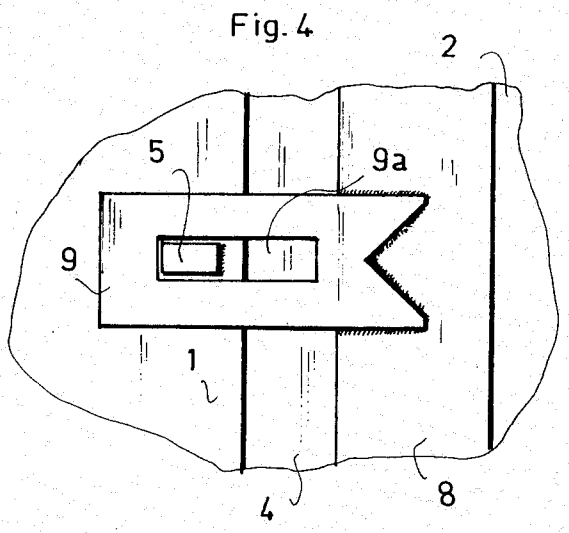
FIGS. 4 and 5 are detailed views of one of the slack-fastener elements respectively shown in front and sectional views.
Figure 3:
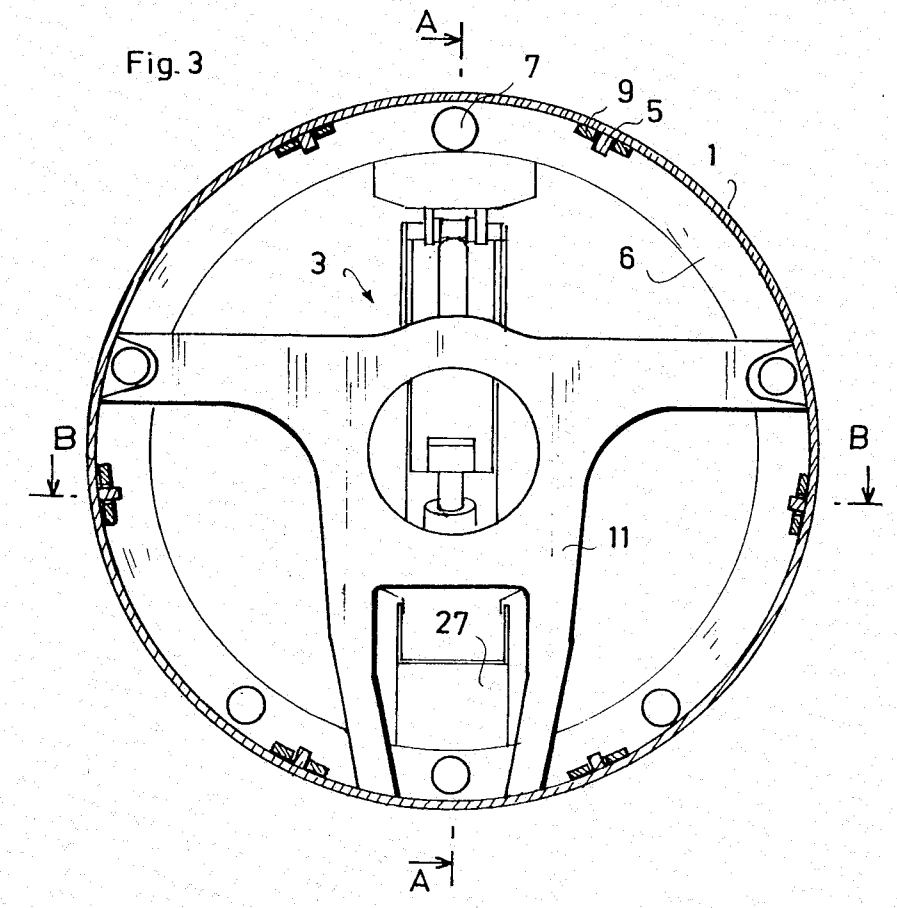
FIG. 3 is a partial section through a cross-plane CC of said machine.

The earth removed by the device is evacuated rearward in conventional manner by a conveyor schematically indicated by 27 in FIGS. 1, 2 and 3; this conveyor passes through an opening in the lower foot of the structure 11.

FIGS. 6 through 10 illustrate the operation of the machine when a curved gallery must be made.

Figure 6:
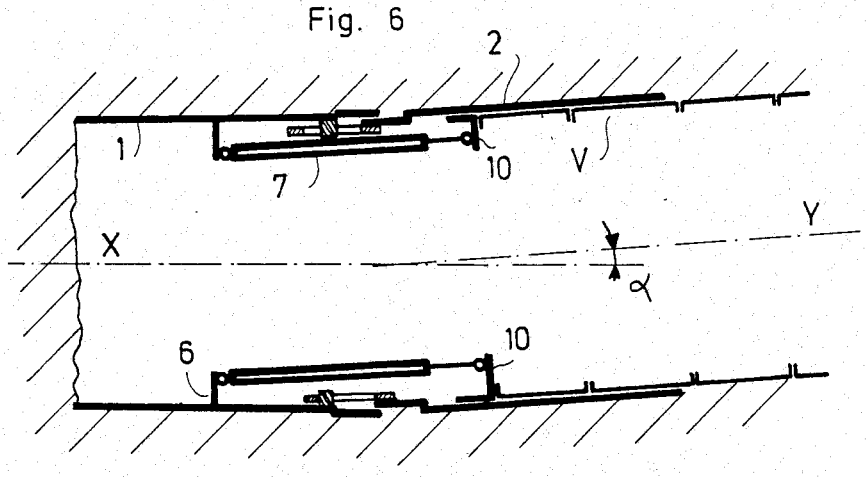

At the beginning of the operational cycle, the machine is assumed being in the geometry of FIG. 6. The X-axis of the knife casing 11 subtends an angle $\alpha$ with the Y-axis of the assembly skirt 2, this angle depending on the curvature of the gallery to be made. The jacks 7 are retracted, those at the outside of the curve evincing more substantial extensions fitting the variable distances between the link points of the various jacks on the forward support 6 and the sliding ring 10. This sliding ring 10 is in its most forward position and rests against the last coverings put in place in the skirt (hoops V).

Figure 7:
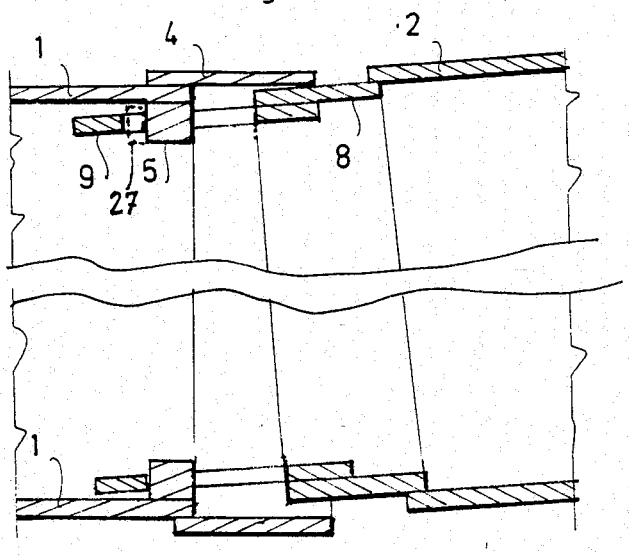
FIG. 7 is a schematic partially showing the slack fastening system in the position of FIG. 6 (the angle subtended by the knife casing and the assembly skirt was exaggerated for illustration in these Figures).

The slack fastening between the knife casing 1 and the skirt 2 is in the schematic position shown in FIG. 7. Chocks such as schematically indicated in broken lines by 27 and of different lengths can be put in place to lock the skirt and the knife casing in the suitable angular position defined by the differential extension of the jacks 7. In particular these removable clocks can be placed by hand against the traction studs 5 in the apertures of the coupling lugs 9. The set of chocks so emplaced allows precisely maintaining the value of the angle $\alpha$ between the X and Y axes of the knife casing and the skirt during the advance motions of the shield.

Figure 8:
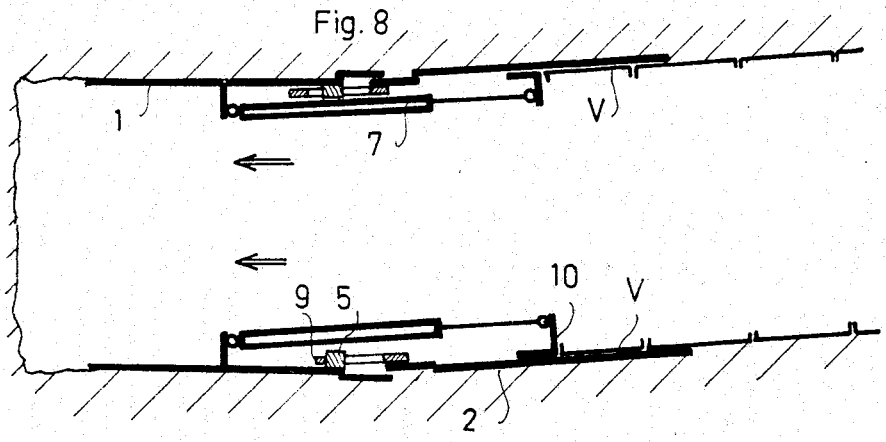
Figure 9:
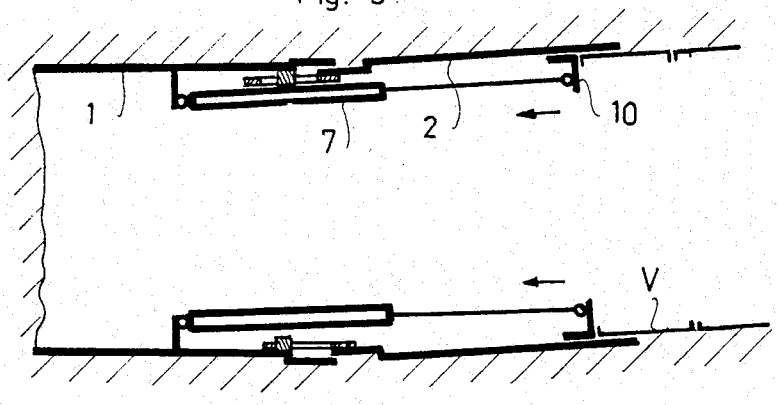

After the digging device (omitted from these Figures) has burrowed a new length of passageway, the jacks 7 will be actuated independently in extension to advance the shield (FIG. 8). This motion is implemented by the thrust ring 10 resting on the hopps V that keep this ring motionless: due to the thrust by the jacks 7, the knife casing 1 therefore is made to slide forward in the new burrowed length, the skirt 2 following because the advance motion is transmitted to it by the traction studs 5 engaging the lugs 9 and by the jacks 7 connecting the knife casing and the assembly skirt.

When the knife casing 1 has reached the end of the burrowed length, the jacks 7 will be retracted by actuating them independently so as to maintain their differential extensions (FIG. 9); thereupon the slide ring is returned to the fore of the assembly skirt 2.

Figure 10:
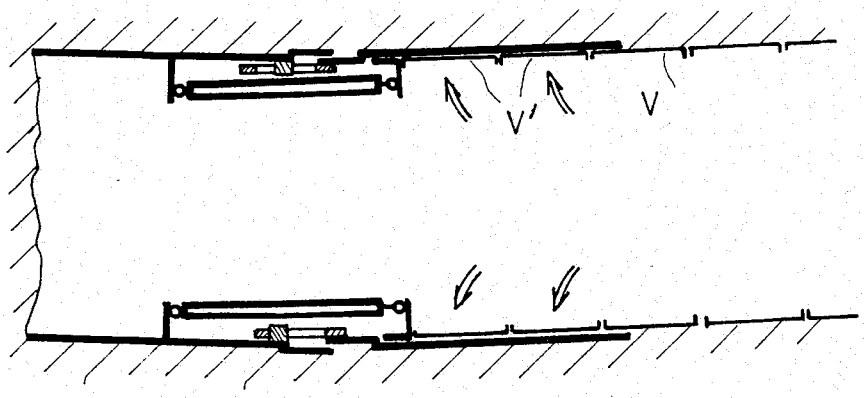

Thereupon it suffices to conventionally mount new hoops (V') in the assembly skirt 2 and a new cycle may start again (FIG. 10).

Such a machine, wherein the knife casing 1 and the assembly skirt 2 are capable of subtending an angle up to 4° makes easily possible galleries with curvatures as low as 15 times their diameter; three persons are sufficient to operate this machine and the average advance might be about 5 meters per 8-hour shift.

What is claimed is:

1. A machine for making underground galleries comprising a hydraulic shield provided with a thrust ring (10) and a hydraulic thrust system (7), said shield comprising a knife casing (1) and an assembly skirt (2), each having a longitudinal axis and being moveable with respect to said each other, a digging device (3) housed within said knife casing, and slack fastener means (4, 5, 8, 9) for connecting said knife casing and said assembly skirt in such a manner as to permit pivotal motion of said knife casing and said assemly skirt about an axis orthogonal to said longitudinal axes whereby said longitudinal axes may form an adjustable angle therebetween.

2. A machine as in claIm 1 and wherein said slack fastener means between said knife casing (1) and said assembly skirt (2) is designed to permit an adjustable relative pivoting motion between said casing and said skirt up to about 4°.

3. A machine as in claim 1, and wherein said slack fastener means comprises a plurality of coupling lugs (9) and traction studs (5) distributed around the shield, said lugs being linked to the front of said assembly skirt (2) and said studs being attached to the rear of the knife casing (1), each traction stud entering an aperture (9*a*)

of a coupling lug (9) with a clearance designed to allow said relative pivoting motion between said knife casing and said assembly skirt.

4. A machine as in claim 3 and wherein said knife casing (1) is provided with an external centering sleeve (4) fixed to its rear end and nesting an inside centering sleeve (8) fixed to the front of the assembly skirt (2), said sleeves (4, 8) being so dimensioned that they are spaced by an operational clearance so as to permit said relative pivoting motion between the knife casing and the assembly skirt.

5. A machine as in claim 4 and wherein said coupling lugs (9) are welded on the inside to the front of the inside centering sleeve (8) of the skirt, the traction studs being welded on the inside to the rear of the knife casing (1) near its junction with the outer centering sleeve (4).

6. A machine as in claim 5 and wherein said hydraulic thrust system of the shield comprises a plurality of hydraulic jacks (7) with independent controls and spaced circumferentially around the shield, each jack (7) being linked at the front to an annular support (6) fixed to the knife casing (1) and at the rear to the thrust ring (10) sliding in the assembly skirt (2).

7. A machine as in claim 6 and including a set of removable chocks (27, 28) for placement against the traction studs (5) in apertures (9*a*) of coupling lugs for locking the skirt and the knife casing in the angular geometry defined by the hydraulic jacks (7).

8. A machine as in claim 7 and wherein said digging device comprises:

a fixed structure (11) fastened to the inside of the knife casing (1) and forming an essentially vertical platform (11*a*) around the longitudinal axis of said casing, a roller ring (13) supported on said platform (11*a*) in such a manner that the axis of said ring coincides substantially with the longitudinal axis (X) of the knife casing, a revolving frame (12) supported by said roller ring (13) so as to be pivotable by 360° and essentially about the longitudinal axis (X) of the knife casing, means (14, 15, 16) for rotationally driving the revolved frame (12), a digging jib (18) hinging on the revolving frame (12) and provided at its end with an operational implement (23), and a hydraulic jack (20) for actuating said jib and linked to said jib and to said revolving frame in such a manner that the hinge point (17) of the jib on the frame, the link point (21) of the jack on the frame, and the link point (19) of the jack on the jib cannot be aligned.

9. A machine as in claim 8, and wherein said fixed structure (11) and its platform (11*a*) are hollow in the central region of the knife casing (1) for defining a central cavity at the rear of the revolving frame (12), the digging jib hinging on said revolving frame near the plane of the platform (11*a*) and comprising a rearward extension (18*a*) housed in the cavity of the structure (11) and to which is linked to actuating jack (20).

10. Machine per claim 9, characterized in that the revolving frame (12) is provided at the location opposite the jib hinge point (17) with a forward extension (12*a*) to which is linked the actuation jack (20).

11. A machine as in claim 10 and wherein said digging jib (18) comprises two telescoping legs (18*a*, 18*b*) sliding within each other and a hydraulic jack (22) linked to said legs in order to retract or advance said telescoping legs.

12. A machine as in claim 11, and comprising a digging jib (18) provided with a scoop (23) and actuating hydraulic means (24, 25) designed to allow said scoop to operate forward or backward.

* * * * *